US012742562B2

(12) United States Patent
Moon

(10) Patent No.: US 12,742,562 B2
(45) Date of Patent: Sep. 22, 2026

(54) INDOOR ENVIRONMENT CONTROL SYSTEM AND OPERATION METHOD THEREOF

(71) Applicant: INDUSTRY-ACADEMIC COOPERATION FOUNDATION, DANKOOK UNIVERSITY, Yongin-si (KR)

(72) Inventor: Hyeun Jun Moon, Gwacheon-si (KR)

(73) Assignee: INDUSTRY-ACADEMIC COOPERATION FOUNDATION, DANKOOK UNIVERSITY, Yongin-si (KR)

( * ) Notice: Subject to any disclaimer, the term of this patent is extended or adjusted under 35 U.S.C. 154(b) by 422 days.

(21) Appl. No.: 18/289,041

(22) PCT Filed: Jul. 21, 2022

(86) PCT No.: PCT/KR2022/010683
§ 371 (c)(1),
(2) Date: Oct. 31, 2023

(87) PCT Pub. No.: WO2023/008825
PCT Pub. Date: Feb. 2, 2023

(65) Prior Publication Data

US 2024/0219050 A1 Jul. 4, 2024

(30) Foreign Application Priority Data

Jul. 27, 2021 (KR) ..... 10-2021-0098280
Jul. 27, 2021 (KR) ..... 10-2021-0098282
Aug. 9, 2021 (KR) ..... 10-2021-0104447

(51) Int. Cl.
*F24F 11/00* (2018.01)
*F24C 15/20* (2006.01)
(Continued)

(52) U.S. Cl.
CPC ..... *F24F 11/0001* (2013.01); *F24C 15/20* (2013.01); *F24F 7/00* (2013.01);
(Continued)

(58) Field of Classification Search
CPC .. F24F 11/0001; F24F 7/00; F24F 8/80; F24F 11/70; F24F 2110/10; F24F 2110/20;
(Continued)

(56) References Cited

U.S. PATENT DOCUMENTS

2015/0032264 A1* 1/2015 Emmons ..... F24F 11/0001 700/276
2021/0190360 A1* 6/2021 Lee ..... G05B 13/027
(Continued)

FOREIGN PATENT DOCUMENTS

KR 10-2018-0057780 A 5/2018
KR 10-1866861 B1 6/2018
(Continued)

*Primary Examiner* — Alicia M. Choi
(74) *Attorney, Agent, or Firm* — Bridgeway IP Law Group, PLLC; Jihun Kim

(57) ABSTRACT

Provided is an indoor environment control system including: an indoor environment device which includes a ventilator, an air purifier, and a kitchen hood; a thermal comfort device which includes a heater, an air cooler, a humidifier, and a controller; and a control device which, when the indoor temperature and humidity are within a preset comfort range, controls an operation of at least one of the indoor environment device and the thermal comfort device on the basis of indoor and outdoor fine dust concentrations.

10 Claims, 11 Drawing Sheets

(51) Int. Cl.

| | |
|---|---|
| ***F24F 7/00*** | (2021.01) |
| ***F24F 8/80*** | (2021.01) |
| ***F24F 11/70*** | (2018.01) |
| *F24F 110/10* | (2018.01) |
| *F24F 110/20* | (2018.01) |
| *F24F 110/65* | (2018.01) |

(52) U.S. Cl.
CPC ..... *F24F 8/80* (2021.01); *F24F 11/70* (2018.01); *F24F 2110/10* (2018.01); *F24F 2110/20* (2018.01); *F24F 2110/65* (2018.01)

(58) Field of Classification Search
CPC ..... F24F 2110/65; F24F 2011/0002; F24F 2110/12; F24F 8/10; F24F 11/00; F24F 11/30; F24F 11/63; F24F 11/64; F24F 11/89; F24C 15/20; F24C 15/2021; G05B 23/02; G06N 3/08; G06N 20/00; G06V 40/20; Y02B 30/70
See application file for complete search history.

(56) References Cited

U.S. PATENT DOCUMENTS

| | | | | |
|---|---|---|---|---|
| 2021/0356158 | A1* | 11/2021 | Kwon | G06N 3/04 |
| 2022/0221184 | A1* | 7/2022 | Gupta | F24F 11/47 |
| 2022/0307716 | A1* | 9/2022 | Park | F24F 11/46 |

FOREIGN PATENT DOCUMENTS

| | | | | | |
|---|---|---|---|---|---|
| KR | 10-2019-0012295 | A | | 2/2019 | |
| KR | 10-2019-0036574 | A | | 4/2019 | |
| KR | 10-2019-0044032 | A | | 4/2019 | |
| KR | 20190044032 | A | * | 4/2019 | F24F 11/61 |
| KR | 10-2019-0119967 | A | | 10/2019 | |
| KR | 10-1996618 | B1 | | 10/2019 | |
| KR | 10-2095990 | B1 | | 4/2020 | |
| KR | 10-2020-0108969 | A | | 9/2020 | |
| KR | 20210021880 | A | * | 3/2021 | F24C 15/2021 |
| KR | 10-2021-0089045 | A | | 7/2021 | |
| KR | 10-2022-0014312 | A | | 2/2022 | |
| KR | 10-2022-0014314 | A | | 2/2022 | |

* cited by examiner

| | | PREDICTIVE VALUES | |
|---|---|---|---|
| | | POSITIVE (1) | NEGATIVE (0) |
| ACTUAL VALUES | POSITIVE (1) | TP | FN |
| | NEGATIVE (0) | FP | TN |

FIG. 7

INDOOR ENVIRONMENT CONTROL SYSTEM AND OPERATION METHOD THEREOF

TECHNICAL FIELD

The present invention relates to an indoor environment control system and an operation method thereof, and more particularly, to an indoor environment control system which, when indoor temperature and humidity are within a preset comfort range, may improve an indoor air quality depending on an indoor fine dust concentration and an outdoor fine dust concentration, and an operation method thereof.

BACKGROUND ART

In general, when a cooling device such as an air conditioner operates for cooling, the relative humidity may be lowered due to dehumidification, and a humidity for operating a heating device such as a boiler for heating may be lowered.

The temperature is slightly lowered during the operation of the humidifier and the temperature is slightly increased during the operation of the dehumidifier.

When the cooling and dehumidification are necessary at the same time, only the cooling device can be operated. However, the humidity is lowered during the cooling and the indoor air is dried to lower the relative humidity during the heating so that the cooling and heating devices and the dehumidifier may be operated in consideration of the temperature and the humidity.

Therefore, the energy can be wasted, overcooled, or overheated.

Further, a user who realizes that the indoor air quality is bad may operate the ventilator or open a window to ventilate, which changes the room temperature so that a separate energy to cool or heat is required again.

As described above, when the indoor environment devices are individually controlled, individual target environmental factors are changed, but other environmental factors may be unintentionally affected, which causes the energy waste.

In order to solve this problem, an integrated control approach has been proposed, but this is limited to rapid (that is, the operating time is shortened as much as possible) control using only the temperature and the humidity, but does not consider how to improve the indoor air quality. In recent years, an integrated control approach which considers thermal comfort for temperature and humidity in the room and improves the indoor air quality is being studied.

DISCLOSURE

Technical Problem

An object of the present invention is to provide an indoor environment control system which when indoor temperature and humidity are within the comfort range, improves an indoor air quality according to an indoor fine dust concentration and an outdoor fine dust concentration and an operation method thereof.

An object of the present invention is to provide an indoor environment control system which extracts an occupant's behavior according to an indoor environment value and a power consumption value and easily maintains a reference indoor environment value set according to the occupant's behavior and an operation method thereof.

The object of the present disclosure is not limited to the above-mentioned objects and other objects and advantages of the present disclosure which have not been mentioned above can be understood by the following description and become more apparent from exemplary embodiments of the present disclosure. Further, it is understood that the objects and advantages of the present disclosure may be embodied by the means and a combination thereof in the claims.

Technical Solution

An indoor environment control system according to the present invention may include an indoor environment device which includes a ventilator, an air purifier, and a kitchen hood; a thermal comfort device which includes a heater, an air cooler, a humidifier, and a controller; and a control device which, when the indoor temperature and humidity are within a preset comfort range, controls an operation of at least one of the indoor environment device and the thermal comfort device based on the indoor fine dust concentration and the outdoor fine dust concentration.

The control device may include: a sensor module which measures the temperature, the humidity, the indoor fine dust concentration, and the outdoor fine dust concentration; and a control module which when the temperature and the humidity are within the comfort range, compares the indoor fine dust concentration and the outdoor fine dust concentration to control an operation of at least one of the ventilator, the air purifier, and the kitchen hood.

The control module may include: a calculation module which calculates a concentration difference by comparing the indoor fine dust concentration and the outdoor fine dust concentration; and an operation module which controls an operation of at least one of the ventilator, the air purifier, and the kitchen hood according to the concentration difference.

When the concentration difference is within a first reference concentration difference range and the indoor fine dust concentration is higher than the outdoor fine dust concentration, the operation module may operate the ventilator and the kitchen hood according to the first reference concentration difference to be turned on.

When the concentration difference is within a second reference concentration difference range and the indoor fine dust concentration is higher than the outdoor fine dust concentration, the operation module may operate the ventilator, the kitchen hood, and the air purifier according to the second reference concentration difference to be turned on.

When the concentration difference is within a third reference concentration difference range and the indoor fine dust concentration is lower than the outdoor fine dust concentration, the operation module may operate the air purifier according to the third reference concentration difference to be turned on.

The indoor environment control system according to the present invention may further include an operation state determining device which determines an operation state of at least one of the heater and the air cooler. The operation state determining device may include: a sensor which measures arbitrary indoor and outdoor environment data; a collection device which collects operation state data of an air conditioning device which cools and heats the indoor; and a learning device which trains a machine learning model based on the environment data and the operation state data to generate a learning model to predict the operation state of the air conditioning device for environment data.

The control device may further include: a power measurement module which measures a power consumption value consumed by every electronic device, and the control module may extract behavior information of an occupant located in the room by applying an indoor environment value measured by the sensor module and the power consumption value to a preset occupant behavior classification model and control the indoor environment device to maintain the indoor environment value as a reference indoor environment value corresponding to the behavior information.

An operation method of an indoor environment control system according to the present invention may include measuring indoor temperature and humidity, an indoor fine dust concentration, and an outdoor fine dust concentration; determining whether the temperature and the humidity are within a preset comfort range; calculating a concentration difference by comparing the indoor fine dust concentration and the outdoor fine dust concentration when the temperature and the humidity are within the comfort range; and controlling an operation of at least one of a ventilator, an air purifier, and a kitchen hood included in an indoor environment device based on the concentration difference.

The operation method may further include operating at least one of a heater, an air cooler, a humidifier, and a dehumidifier so that the temperature and the humidity fall into the comfort range when the temperature and the humidity are not within the comfort range.

In the controlling of an operation, when the concentration difference is within a first reference concentration difference range and the indoor fine dust concentration is higher than the outdoor fine dust concentration, the ventilator and the kitchen hood may operate to be turned on according to the first reference concentration difference.

In the controlling of an operation, when the concentration difference is within a second reference concentration difference range and the indoor fine dust concentration is higher than the outdoor fine dust concentration, the ventilator, the kitchen hood, and the air purifier may operate to be turned on according to the second reference concentration difference.

In the controlling of an operation, when the concentration difference is within a third reference concentration difference range and the indoor fine dust concentration is lower than the outdoor fine dust concentration, the air purifier may operate to be turned on according to the third reference concentration difference.

Advantageous Effects

The indoor environment control system according to the present invention and the operation method thereof have advantages of increasing thermal comfort based on indoor temperature and humidity and improving the indoor air quality based on the indoor fine dust concentration and the outdoor fine dust concentration to increase the convenience of an occupant or a user.

The indoor environment control system according to the present invention and the operation method thereof have advantages of maintaining a comfortable condition in the room by inferring the behavior of the occupant located in the room based on the indoor environment value and the power consumption value in the room and controlling indoor environmental devices to maintain the indoor environment value to a reference indoor environment value according to the behavior of the occupant.

The effects of the present disclosure are not limited to the aforementioned effects, and various other effects are included within a range which is obvious to those skilled in the art from the following description.

DESCRIPTION OF DRAWINGS

FIG. 7 is a classification table for explaining a confusion matrix according to an exemplary embodiment of the present invention.

BEST MODE

Figure 1:
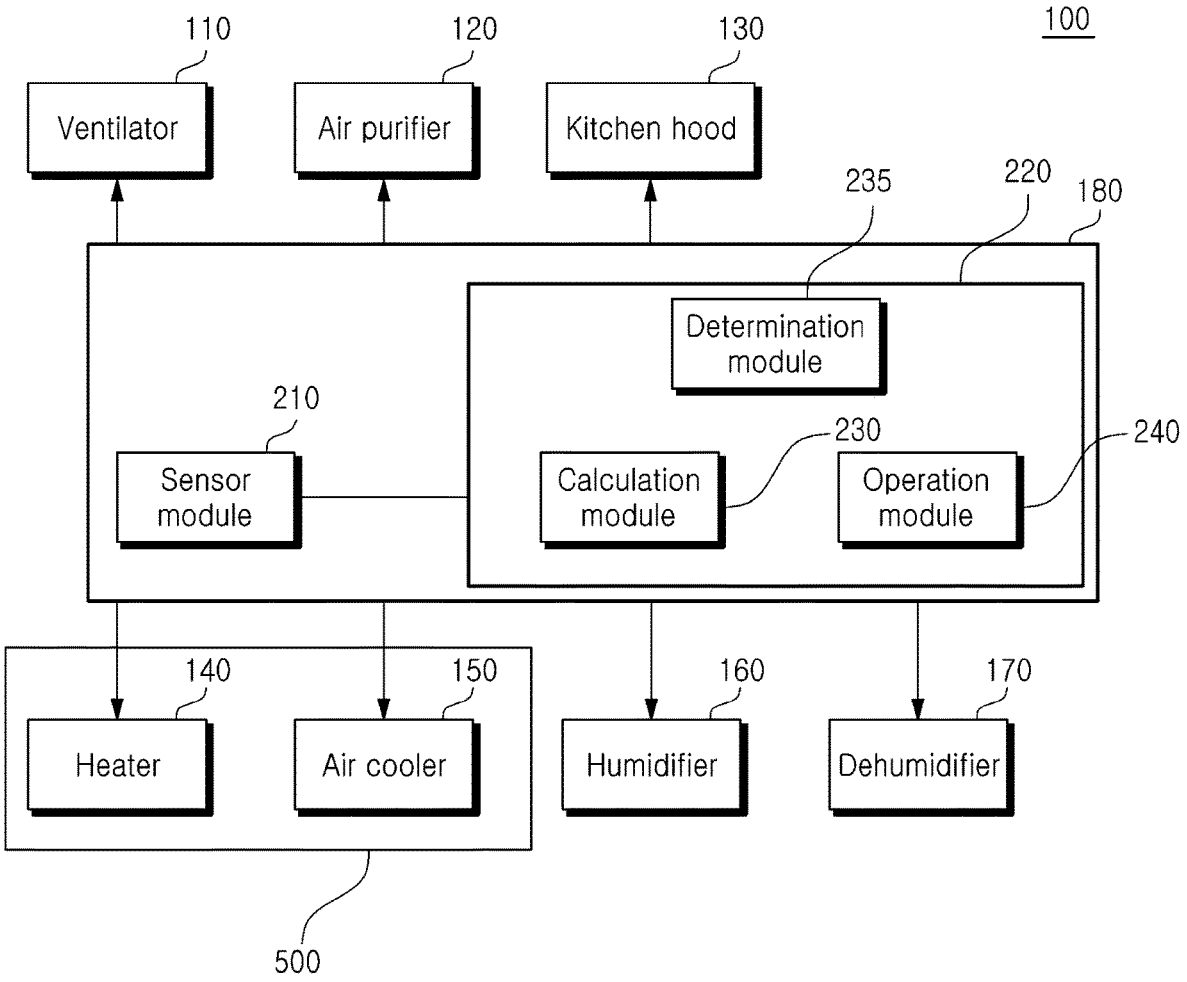
FIG. 1 is a control block diagram illustrating a configuration of an indoor environment control system according to a first exemplary embodiment of the present invention.

Those skilled in the art may make various modifications to the present disclosure and the present disclosure may have various exemplary embodiments thereof, and thus specific exemplary embodiments will be illustrated in the drawings and described in detail in the detailed description. However, it should be understood that the present disclosure is not limited to the specific exemplary embodiments, but includes all changes, equivalents, or alternatives which are included in the spirit and technical scope of the present invention. In the description of respective drawings, similar reference numerals designate similar elements.

Terms such as first, second, A, or B may be used to describe various components but the components are not limited by the above terms. The above terms are used only to distinguish one component from the other component. For example, without departing from the scope of the present invention, a first component may be referred to as a second component, and similarly, a second component may be referred to as a first component. The term "and/or" includes combinations of a plurality of related elements or any one of the plurality of related elements.

It should be understood that, when it is described that an element is "coupled" or "connected" to another element, the element may be directly coupled or directly connected to the other element or coupled or connected to the other element through a third element. In contrast, when it is described that an element is "directly coupled" or "directly connected" to another element, it should be understood that no element is present therebetween.

Terms used in the present application are used only to describe a specific exemplary embodiment, but are not intended to limit the present disclosure. A singular form may include a plural form if there is no clearly opposite meaning in the context. In the present disclosure, it should be understood that terminology "include" or "have" indicates that a feature, a number, a step, an operation, a component, a part or the combination thereof described in the specification is present, but does not exclude a possibility of presence or addition of one or more other features, numbers, steps, operations, components, parts or combinations, in advance.

If it is not contrarily defined, all terms used herein including technological or scientific terms have the same meaning as those generally understood by a person with ordinary skill in the art. Terms which are defined in a generally used dictionary should be interpreted to have the same meaning as the meaning in the context of the related art but are not interpreted as an ideally or excessively formal meaning if it is not clearly defined in the present invention.

Hereinafter, exemplary embodiments according to the present invention will be described in detail with reference to accompanying drawings.

FIG. 1 is a control block diagram illustrating a configuration of an indoor environment control system according to a first exemplary embodiment of the present invention.

Referring to FIG. 1, the indoor environment control system 100 may include a ventilator 110, an air purifier 120, a kitchen hood 130, a heater 140, an air cooler 150, a humidifier 160, a dehumidifier 170, and a control device 180.

In an exemplary embodiment, the indoor environment device (not illustrated) may include a ventilator 110, an air purifier 120, and a kitchen hood 130 and these are devices for improving the indoor air quality, but are not limited thereto.

The thermal comfort device (not illustrated) may include a heater 140, an air cooler 150, a humidifier 160, and a dehumidifier 170 and these are devices which improve the thermal comfort by adjusting the indoor temperature and humidity, but are not limited thereto.

The ventilator 110 is a forced air ventilation device using the energy and may perform a function of improving the indoor air quality although it has slightly less control over temperature and humidity.

The air purifier 120 may perform a function of improving an indoor air quality by removing foreign materials included in the indoor air.

The kitchen hood 130 may exhaust carbon dioxide and odors generated during cooling to the outside and additionally perform a function of improving the indoor air quality.

The heater 140 may perform the heating function by increasing the indoor temperature and the air cooler 150 may perform a cooling function of lowering the indoor temperature, unlike the heater 140.

The humidifier 160 and the dehumidifier 170 may perform a function of adjusting the indoor humidity.

According to the exemplary embodiment, the indoor environment control system may further include an operation state determining device 500 which determines operation conditions of the heater 140 and the air cooler 150. An operation method of the operation state determining device 500 will be described below in detail.

The control device 180 may include a sensor module 210 and a control module 220.

The sensor module 210 may include a plurality of sensors which is capable of measuring an indoor temperature, an indoor humidity, an indoor fine dust concentration, and an outdoor fine dust concentration, but is not limited thereto.

For example, the plurality of sensors may include a temperature sensor, a humidity sensor, an odor sensor, a dust sensor, and the like, but is not limited thereto.

Further, the sensor module 210 may output indoor environmental values data1 measured by the plurality of sensors.

The indoor environmental values data1 may include a temperature, a humidity, a carbon dioxide value, a noise level, an illumination intensity, a volatile organic compound (VOC) dose, and a fine dust dose, but are not limited thereto.

For example, the plurality of sensors may be installed in the rooms, living rooms, and kitchens and a temperature, a humidity, a carbon dioxide value, a noise level, an illumination intensity, a volatile organic compound (VOC) dose, and a fine dust dose may be values measured from the rooms, the living rooms, and the kitchens, but are not limited thereto.

In one exemplary embodiment, the control module 220 may further include a power measurement module (not illustrated).

The power measurement module may measure a power consumption value data2 which is consumed for every electronic device disposed in the room.

First, the power measurement module may be a smart meter which measures the power consumption for every electronic device, but is not limited thereto.

Here, the electronic devices may include a TV, lights, a washing machine, a microwave, an air conditioner (a system air conditioner), a rice cooker, a hair dryer, a hot water mat, a humidifier, a ventilator, an air purifier, and a laptop, but are not limited thereto.

The control module 220 may include a calculation module 230 and an operation module 240.

The calculation module 230 may calculate a concentration difference by comparing the indoor fine dust concentration and the outdoor fine dust concentration.

Here, the concentration difference is a value obtained by subtracting the outdoor fine dust concentration from the indoor fine dust concentration. For example, when the concentration difference has a negative (−) value, it means that the outdoor fine dust concentration is higher than the indoor fine dust concentration. Further, when the concentration difference has a positive (+) value, it means that the indoor fine dust concentration is higher than the outdoor fine dust concentration.

First, when the indoor temperature and humidity are input, the operation module 240 may determine whether the temperature and the humidity are within the set comfort range.

That is, the operation module 240 may determine whether the temperature and the humidity are within the comfort range before improving the indoor air quality to increase the thermal comfort.

As the comfort range, for example, the comfort temperature may be 24.4° C. to 26.5° C. and the comfort humidity may be 40% to 55%. The comfort range may be changed by the user.

When the temperature is lower than the comfort temperature and the humidity is higher than the comfort humidity, the operation module 240 may operate in a heating comfort mode to operate at least one of the heater 140 and the dehumidifier 170.

Further, when the temperature is lower than the comfort temperature and the humidity is within the comfort humidity, the operation module 240 may operate in a heating comfort mode to operate the heater 140.

When the temperature is higher than the comfort temperature and the humidity is lower than the comfort humidity, the operation module 240 may operate in a cooling comfort mode to operate at least one of the air cooler 150 and the humidifier 160.

When the temperature is higher than the comfort temperature and the humidity is higher than the comfort humidity, the operation module 240 may operate in a cooling comfort mode to operate at least one of the air cooler 150 and the dehumidifier 170.

When a concentration difference is input from the calculation module 230 during the operation in the heating or cooling comfort mode, the operation module 240 may determine whether the concentration difference is within any one of the first to third reference concentration difference ranges.

First, the first reference concentration difference range may be a range in which the indoor fine dust concentration is higher than the outdoor fine dust concentration and the second reference concentration difference range may be a range in which the indoor fine dust concentration is higher than the outdoor fine dust concentration and is larger than the range of the first reference concentration difference.

The third reference concentration difference range may indicate a range in which the indoor fine dust concentration is lower than the outdoor fine dust concentration.

When the concentration difference is within the range of the first reference concentration difference, the operation module 240 may operate the ventilator 110 and the kitchen hood 130 to be turned on depending on the first reference concentration difference.

That is, the indoor fine dust concentration is higher than the outdoor fine dust concentration so that the operation module 240 may operate the ventilator 110 and the kitchen hood 130 to be turned on to exhaust the indoor air to the outside.

At this time, when the ventilator 110 and the kitchen hood 130 include fans, the operation module 240 may adjust the speeds of the fans.

When the concentration difference is within the range of the second reference concentration difference, the operation module 240 may operate the ventilator 110, the air purifier 120, and the kitchen hood 130 to be turned on depending on the second reference concentration difference.

That is, the indoor fine dust concentration is higher than the outdoor fine dust concentration so that the operation module 240 may operate the ventilator 110, the air purifier 120, and the kitchen hood 130 to be turned on to exhaust the indoor air to the outside and purify the indoor air.

When the concentration difference is within the range of the third reference concentration difference, the operation module 240 may operate the air purifier 120 to be turned on depending on the third reference concentration difference.

That is, the outdoor fine dust concentration is higher than the indoor fine dust concentration so that the operation module 240 may operate the air purifier 120 to be turned on to prevent the outdoor air from entering the room and maintain the current state of the indoor air.

The indoor environment control system 100 according to the present invention has advantages of increasing the thermal comfort in consideration of the indoor temperature and humidity and improving the indoor air quality in consideration of the indoor fine dust concentration in the room and the outdoor fine dust concentration.

According to another exemplary embodiment of the present invention, the control module 220 may further include a determination module 235 in addition to the calculation module 230 and the operation module 240.

The calculation module 230 applies an indoor environment value data1 and a power consumption value data2 to a preset occupant behavior classification model to extract behavior information of an occupant located in the room.

Here, the occupant behavior classification model may be generated by machine-learning of the indoor environment value data1 and the power consumption value data2 which change according to the behavior of the occupant, which will be described with reference to FIGS. 2 to 4.

The calculation module 230 may calculate a first variation of the indoor environment value data1 and a previous indoor environment value and a second variation between the power consumption value data2 and a previous power consumption value and apply the first and second variations to the occupant behavior classification model to extract the behavior information.

The behavior information of the occupant may be any one state of sleeping, going out, cooking, exercising, and resting of an occupant, but is not limited thereto.

The determination module 235 may determine control values of the indoor environment devices (not illustrated) to maintain the indoor environment value data1 to a preset reference indoor environment value.

For example, the indoor environment device may be a ventilator, an air purifier, and a kitchen hood, but is not limited thereto.

Here, the reference indoor environment value may be a predetermined value set to form a comfort environment in the room with respect to a temperature, a humidity, a carbon dioxide value, a noise level, an illumination intensity, a volatile organic compound (VOC) dose, and a fine dust dose.

The determination module 235 may determine control values for operations for the respective indoor environment devices to lower the fine dust and carbon dioxide in a behavior state of the occupant, for example, during exercising. When the behavior state of the occupant is a sleeping state or when the occupant is watching TV in the living room, the control values for operations of the respective indoor environment devices may vary.

The operation module 240 may transmit the control values to the indoor environment device and control the operation of the indoor environment device.

Figure 2:
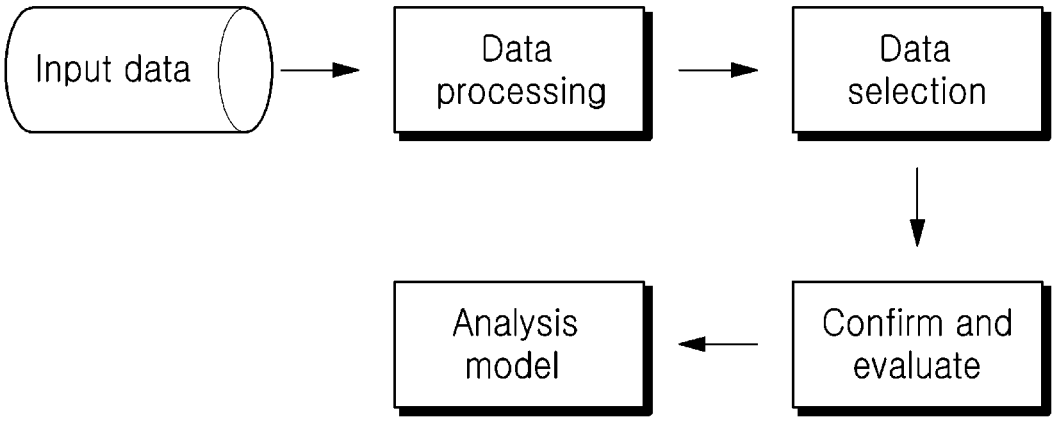
FIGS. 2 to 4 are exemplary views for explaining an occupant behavior classification model applied to a calculation module.
Figure 3:
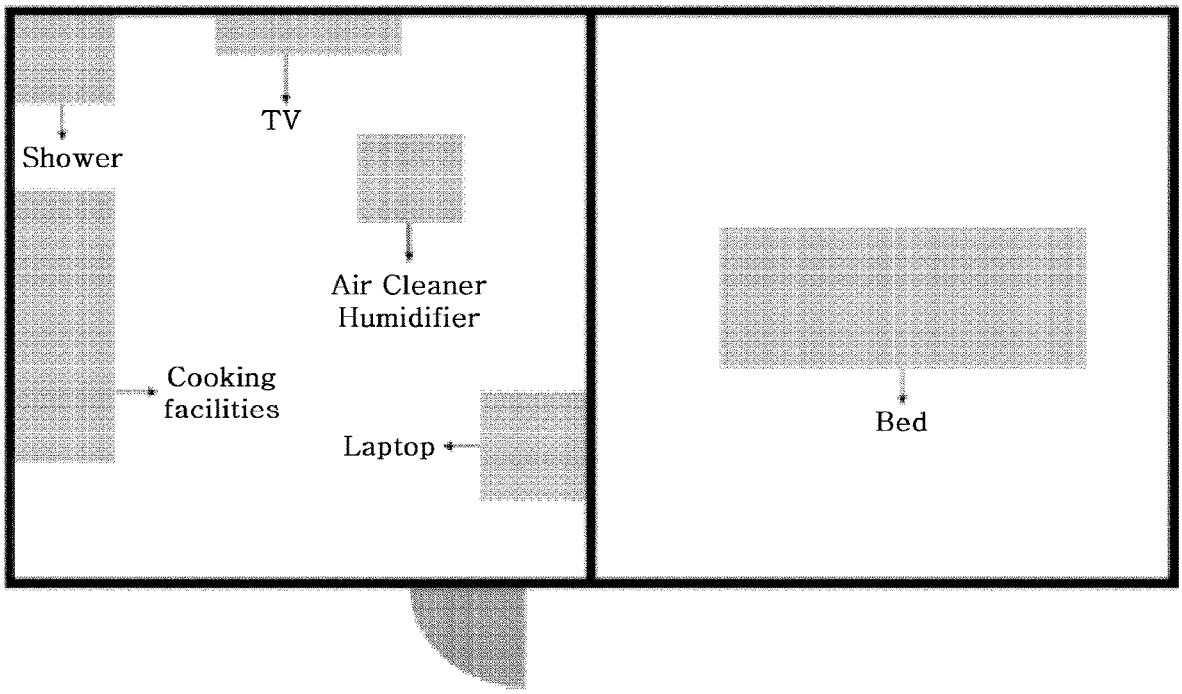
Figure 4:
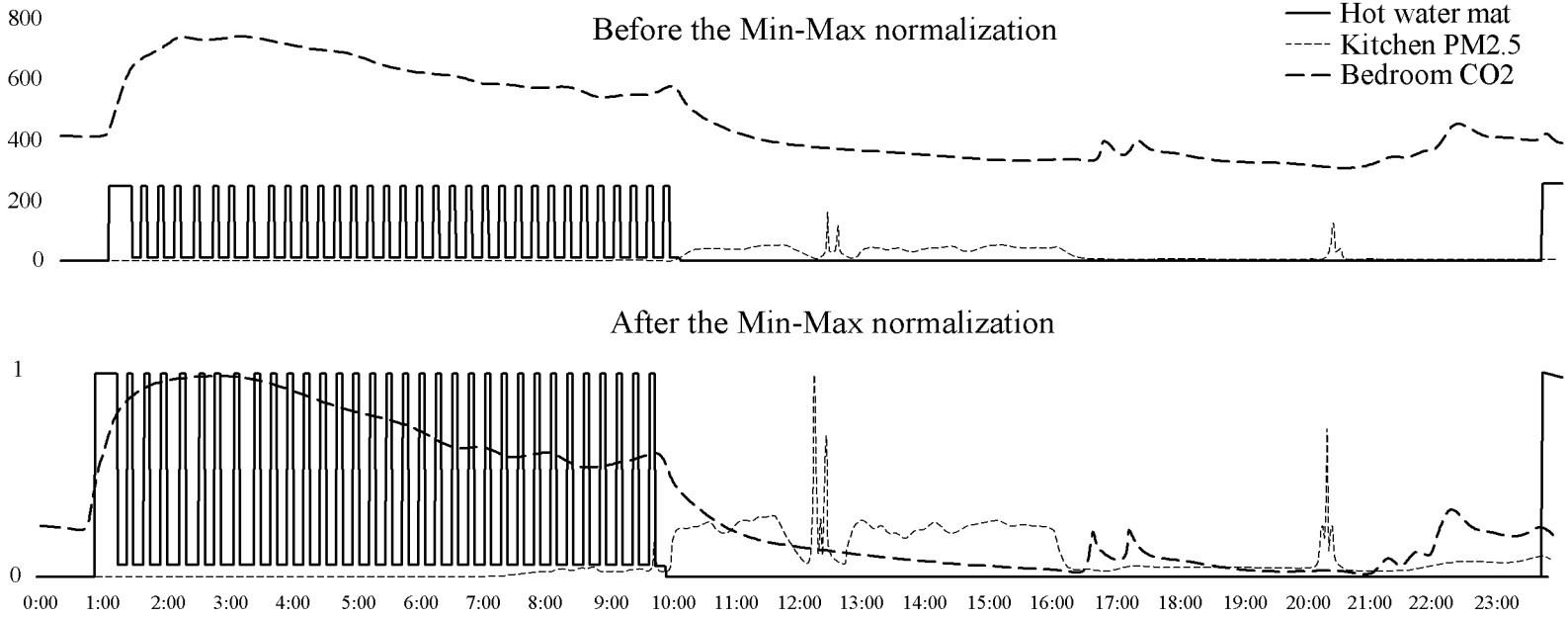

FIGS. 2 to 4 are exemplary views for explaining an occupant behavior classification model applied to a calculation module.

First, FIG. 2 illustrates a data processing process for generating an occupant behavior classification model.

The input data of FIG. 2 may include the indoor environment value data1 and the power consumption value data2 described in FIG. 1 and an output value is designated by an occupant behavior and is subjected to a data preprocessing process to be processed suitable for the model.

The occupant behavior data is separately processed to be converted from image data to categorical data.

The input value of the model uses a variable importance technique using the random forest algorithm, and the classification algorithm of KNN and random forest is applied as a method for developing an occupant recognition model to perform evaluation according to input data and evaluation by classification algorithm.

The python is used for the analysis process and sklearn is utilized for a machine learning library. However, the machine learning algorithm is not limited thereto and various program languages and machine learning libraries may be utilized.

FIG. 3 illustrates locations of shower facilities, cooking facilities, and home appliances for an experiment to create an occupant behavior classification model.

During the experimental period, the calculation module 230 may acquire indoor environment values data1 including a kitchen PM2.5 concentration (PM2.5_K), a living room PM2.5 concentration (PM2.5_L), an outdoor air PM2.5 concentration (PM2.5_O), a bedroom PM2.5 concentration (PM2.5_B), a living room temperature (TEMP_L), a living room relative humidity (RH_L), a living room CO2 concentration (CO2_L), a bedroom temperature (TEMP_B), a bedroom relative humidity (RH_B), and a bedroom CO2 concentration (CO2_B) and a power consumption values data2 including power consumption consumed by each of a washing machine, a microwave, a lighting, a system air conditioner, a rice cooker, a dryer, a TV, a hot water mat, a humidifier, a ventilator, an air purifier, and a laptop.

The occupant behavior information during the data collecting step is collected by a web camera installed in the living room as image data, but the image data cannot be used for the classification model so that the image data is converted into categorical data with one-minute interval.

In order to label the occupant behavior, it refers to National life time statistical data which classifies the behaviors of Korean citizens, and classifies the occupant behavior from the collected image into behavioral states including sleeping, going out, eating, exercising, using a hair dryer, resting, preparing meals, washing dishes, cleaning, working (computer), walking, and the like and unknown state due to being out of the range of the web camera or poor recording. However, the behavioral classifying method and a classification result may vary and are not limited thereto.

In order to set an output label of the model, which is developed by this study, among the occupant behaviors, a time spent by the subject for every behavior during the experiment is denoted by minutes.

The spent times among the behaviors of the occupant are in this order of sleeping, going out, working, resting, cooking, eating, exercising, washing dishes, using a hair dryer, cleaning, and walking. Top seven behaviors among them account for 98% or more of all the behaviors so that sleeping, going out, working, resting, cooking, eating, and exercising are designated and used by output labels of the model, but it is not limited thereto.

Referring to FIG. 4, the data collected by experiments may be subject to missing values due to instrument errors, failures, or the like and such missing data may degrade the performance of the developed model or produce a biased result.

Accordingly, an imputation process on the missing value needs to be performed in advance.

There are two ways to handle the missing values: simple deletion and substitution with a different value.

However, according to the deletion, there is a risk of removing an important attribute for analyzing a characteristic of the data so that substitution is mostly utilized to be substituted with a mean, a median, or a mode value or machine learning such as K-nearest neighbor (KNN) or an artificial neural network is used.

In the present invention, the missing values are handled by utilizing the KNN. The KNN missing value handling method is a method of predicting and imputing a missing value with the k nearest neighbors to the missing value of given data. This method is frequently used due to its simplicity and a relatively high precision.

Further, different measurement units for every data may cause problems of causing the degradation of the stability of the model, dominating low value data by high value data, and the like. Accordingly, a data normalization (feature scaling) method is necessary to match the ranges of data with different scales based on the characteristics.

As illustrated in FIG. 4, min-max normalization which converts data (x) having different units such as a hot water mat (W), a kitchen PM2.5 concentration ($\mu g/m^3$), and a living room CO2 concentration (ppm) into the range [0, 1] through Equation 1 to unify the range of data.

Further, the number of data for every behavior may be imbalanced due to the occupant behavior characteristics. When the model is developed without addressing the data imbalance, the model may be biased to a majority class to be unable to identify and predict the minority class so preprocessing to address imbalance is essential.

The processing of data imbalance is classified into over sampling to adjust the number of minority classes to the number of majority classes and under sampling to adjust the number of majority classes to the number of minority classes.

The over sampling includes random over sampling which randomly simply copies the minor classes, synthetic minority over-sampling technique (SMOTE) which interpolates the minority classes to create new data, and SMOTE+ENN technique which combines the SMOTE with edited nearest neighbor (ENN) which deletes the majority classes in the vicinity of the minority classes.

The machine learning algorithm is classified into supervised learning, unsupervised learning, and reinforcement learning based on how to analyze data. The supervised learning is a method which trains data of an input value and an output value to determine extraction for a new input value and is utilized for classification and regression.

In the present invention, in order to extract a current occupant's state as an output value using indoor environment and device power consumption data as input values, a classification technique of the supervised learning is utilized. Representative classification techniques include K-nearest neighbor (KNN), random forest, support vector machine (SVM), artificial neural network (ANN), decision tree, Bayesian classification, and the like.

In the present invention, K-nearest neighbor (KNN) and the random forest are utilized and KNN is the simplest machine learning algorithm which was proposed by Cover in 1968.

As a method for classifying unlabeled samples according to a similarity of samples in a training dataset, when new data is given, nearest K labeled samples are found and new data is assigned to a group which most frequently appears in K subsets.

Random forest is a popular method in building energy-related research due to its simplicity and ease of use. Random forest is an ensemble learning method which tests properties of internal nodes, branches the internal nodes according to the results, creates a plurality of decision trees to classify the classes into leaf nodes, and adopts the majority of the results by each tree. The training is performed to lower the impurity between output variables before and after classification.

In order to evaluate the accuracy of the classification results, the validity of the model needs to be evaluated first. This is called validation. There are three types of validation: hold out which is used for validation by randomly dividing the already given train set into a train set and a test set again, bootstrap which randomly resets train and test sets, and cross validation which randomly divides data into k pieces with similar sizes to allow all the data to be used as a test set at least once.

Accordingly, in the present invention, the analysis is performed using 10-fold cross validation which divides data into 10 pieces for validation.

In the classification algorithm, a previous level and a label which is output by the model are compared to evaluate the performance of the model.

Hereinafter, the above-described operation state determining device 500 will be described in more detail with reference to FIGS. 5 to 8.

The operation state determining device 500 determines operation states of the heater 140 and the air cooler 150 through an optimal machine learning model generated based on indoor and outdoor environmental data.

Figure 5:
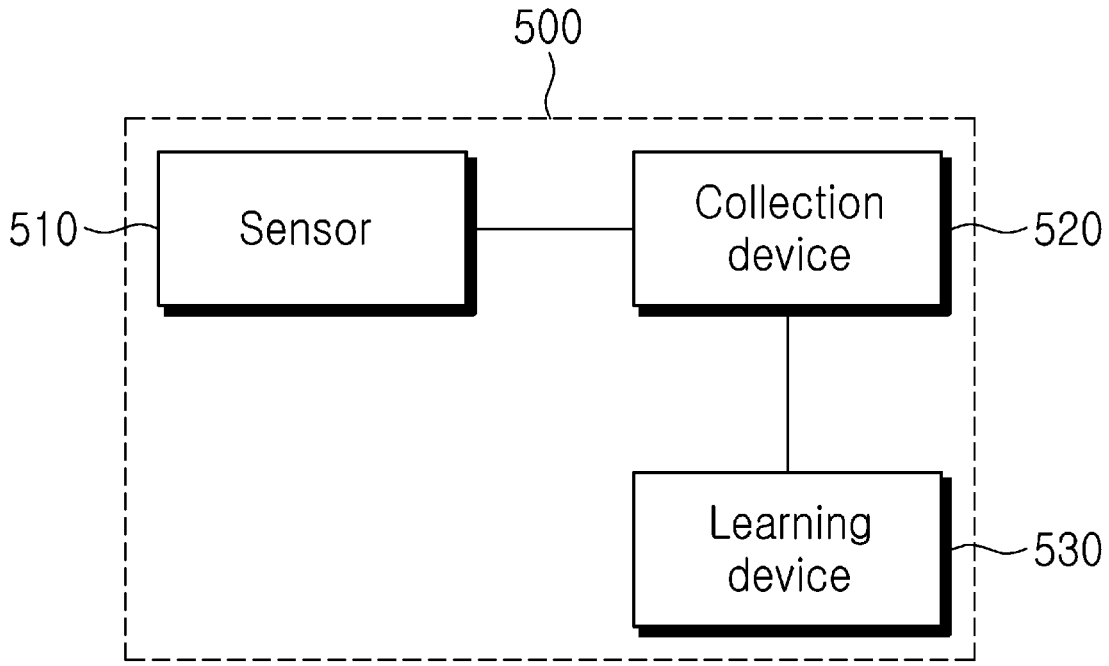
FIG. 5 is a block diagram illustrating a configuration of an operation state determining device of an air conditioning device according to the present invention.
Figure 6:
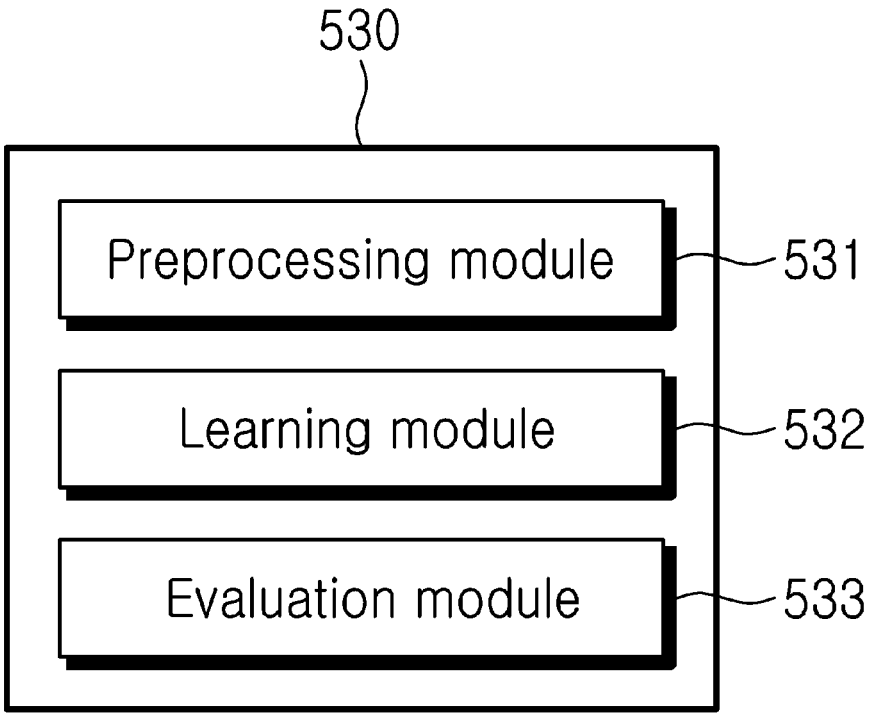
FIG. 6 is a block diagram illustrating a configuration of a learning device according to the present invention.

FIG. 5 is a block diagram illustrating a configuration of an operation state determining device of an air conditioning device according to the present invention and FIG. 6 is a block diagram illustrating a configuration of a learning device according to the present invention.

Referring to FIGS. 5 and 6, an operation state determining device 500 for determining the operation status of an air conditioning device may include a sensor 510, a collection device 520, and a learning device 530.

The sensor 510 may include a plurality of sensors and measure arbitrary indoor and outdoor environment data.

Here, the sensor may be a temperature sensor, a humidity sensor, a carbon dioxide concentration sensor and the environmental data may include indoor temperature, indoor humidity, indoor carbon dioxide concentration, outdoor temperature, and outdoor humidity.

Further, the sensor 510 may further include a dust sensor which measures fine dusts but is not limited thereto.

The collection device 520 may collect operation state data of the indoor air conditioning device. Here, the air conditioning device may be an HVAC system. The HVAC system is an air conditioning system which keeps the inside of buildings or vehicles comfortable through heating, ventilation, and air conditioning systems.

The operation state data may include power-off, power-on, a cooling mode, and a heating mode, but is not limited thereto.

The learning device 530 trains the machine learning model based on the environment data and the operation state data to create a learning model to predict the operation state of the air conditioning device for the environment data.

Referring to FIG. 6, the learning device 530 may include a preprocessing module 531, a learning module 532, and an evaluation model 533.

The preprocessing module 531 time-synchronizes the environment data and the operation state data to create a dataset.

When there is a missing value in the dataset for a predetermined first period of time, for example, 2 minutes or shorter, the preprocessing module 531 may substitute the data with a value immediately prior to the missing value.

When the same value of the environment data is repeated for a predetermined second period of time, the preprocessing module 531 may exclude the corresponding period. For example, when the same value from one or more of the indoor temperature, the indoor humidity, the indoor carbon dioxide concentration, the outdoor temperature, and the outdoor humidity of the environment data is repeated for 520 minutes or longer, the corresponding period is excluded from the dataset.

When data is missing for a predetermined third period of time, for example, three minutes or longer, the preprocessing module 531 excludes the corresponding period from the dataset.

The learning module 532 trains the machine learning model based on the dataset preprocessed by the preprocessing module 531 to create the learning model. The machine learning model may be one of a deep neural network (DNN)-based model, a convolutional neural network (CNN)-based model, and a multichannel recurrence plot (RP) CNN-based model.

The DNN-based model is configured by processes of inputting data, applying a weight and a bias, and outputting data.

In one exemplary embodiment, in order to create the learning model with the DNN-based model, environment data is normalized first. The data range for every item of environment data is set from 0 to 1 by the Minmaxscaler method. Next, in order to reflect the change in each item of the normalized environment data over time, a feature using data for 160 minutes before the prediction time is added. The random forest technique is used to extract the most important features, for example, 75 features. The number of features is reduced to improve the performance of the learning model for prediction and avoid overfitting. In order to avoid the overfitting of the learning model, L1-regularization is employed.

The CNN-based model is a characteristic neural network which locally connects the input values to significantly reduce the learning parameters and a kernel which shares the weight moves horizontally the input values to return the feature map.

In one exemplary embodiment, the CNN-based model may employ the recurrence plot algorithm. Recurrence Plot is one of algorithms used to analyze the dynamic system and converts time series data into an RP matrix, expresses a trajectory of a spatial coordinate of i-th data and j-th data to a coordinate (i,j), uses a dimension m of the spatial coordinate, a time deviation t representing an interval of the coordinates, and a threshold & as parameters, and treats the RP matrix as an image to be available for a CNN model specified for image classification.

The multichannel RP CNN-based model has a conversion RP image for each item of each environment data as a channel. Accordingly, the machine learning is performed on five channel RP images using the CNN.

In one exemplary embodiment, the multichannel RP CNN-based model learning model maintains a time characteristic of raw data to increase the performance of the prediction model.

The RP image is configured by multichannel so that the itemized relationship of the environment data collected at the same timing as compared with the single channel is maintained, resulting in higher prediction performance.

The evaluation module 533 creates an evaluation dataset based on past data and evaluates the performance of the learning model based on the created evaluation dataset.

The evaluation module 533 creates an evaluation dataset by extracting a representative cooling date when the cooling is mainly performed and a representative heating date when the heating is mainly performed, from data included in the dataset.

The evaluation module 533 evaluates the learning model based on a confusion matrix.

The evaluation module 533 performs a performance analysis by comparing the actual value according to a predictive value based on the confusion matrix.

FIG. 7 is a classification table for explaining a confusion matrix according to an exemplary embodiment of the present invention.

Referring to FIG. 7, ACTUAL VALUES refer to actual values and PREDICTIVE VALUES refer to predictive values. That is, TP and TN are portions that correctly predict the actual values and FP and FN are portions that predict differently from the actual value.

In the error classification table, the accuracy is a proportion of the entire validation data that the prediction result and the label match and is calculated by Equation 1.

$$\text{Accuracy}=(TP+TN)/(TP+FN+FP+TN) \quad \text{[Equation 1]}$$

Precision is a proportion of data with positive prediction results which has a positive label and is calculated by Equation 2.

$$\text{Precision}=TP/(TP+FP) \quad \text{[Equation 2]}$$

Recall is a proportion of data with a positive label out of the total validation data which has a positive prediction result and is calculated by Equation 3.

$$\text{Recall}=TP/(TP+FN) \quad \text{[Equation 3]}$$

F1 score is a harmonic mean of precision and recall and is calculated by Equation 4. F1 score is suitable for evaluation when the label of the validation data is imbalanced.

$$F1\text{-score}=2\times\text{Precision}\times\text{Recall}/(\text{Precision}+\text{Recall}) \quad \text{[Equation 4]}$$

The evaluation module 533 of FIG. 6 specifies a range of the hyperparameters to optimize the learning model based on a grid search method, trains the learning device 530 according to all combinations within the corresponding range, and then performs the validation.

The entire target parameter space is searched and influence between parameters is checked. According to the exemplary embodiment, the accuracy of the DNN-based model is 0.83 and the accuracy of the CNN model is 0.96.

Figure 8:
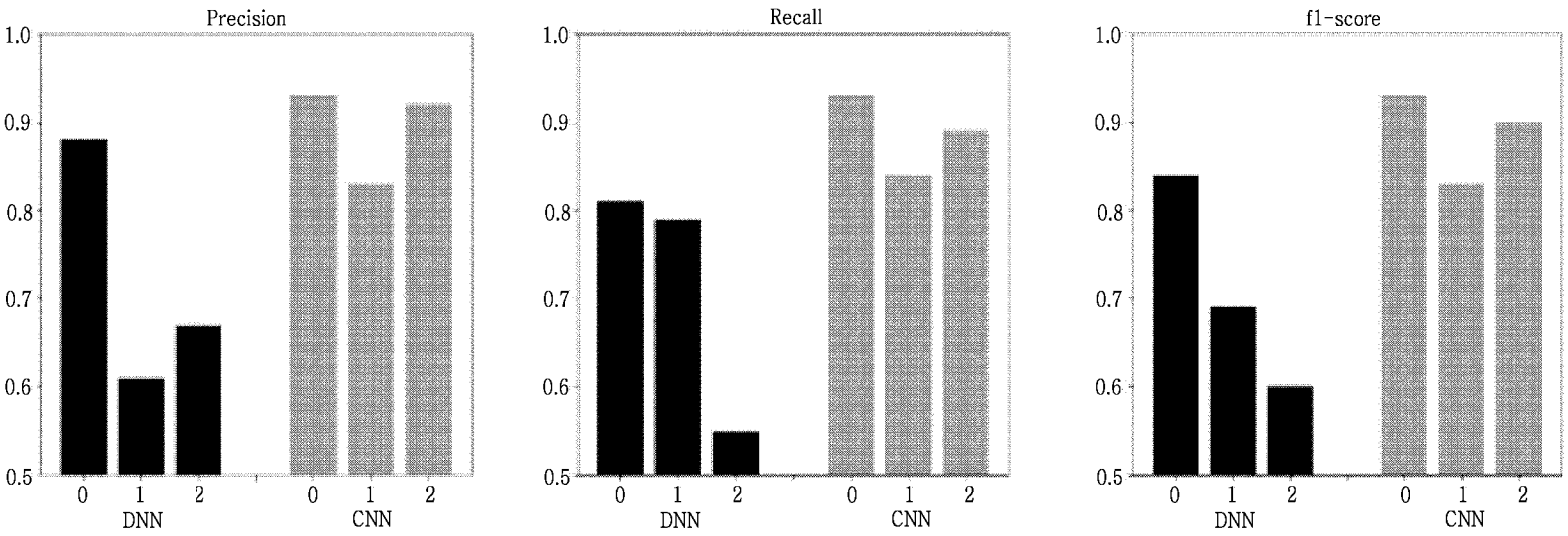
FIG. 8 is a graph comparing a precision, a recall, and an F1 score of a DNN-based learning model and a CNN-based learning model according to an exemplary embodiment of the present invention.

FIG. 8 is a graph comparing a precision, a recall, and F1 score of a DNN-based learning model and a CNN-based learning model according to an exemplary embodiment of the present invention.

Referring to FIG. 8, the CNN-based learning model has higher evaluation results for three states of precision, recall, and F1 score than the DNN-based learning model.

The DNN-based learning model has a low reliability for the prediction result due to low precision for the cooling and the heating and the recall may identify that a performance of detecting the heating state from validation data is degraded.

The DNN-based learning model causes mostly misclassification during the cooling process when the operating state of the air conditioning device changes.

The CNN-based learning model looks to have a higher performance than that of the DNN-based learning model, but when the cooling state is predicted, has a lower performance than that of the other class.

The determination of the operation state of the air conditioning device using the environment data is suitable for detecting the power-off and the heating state.

The CNN-based learning model is not affected by the change in the operation state but causes misclassification when the indoor temperature and humidity sharply change.

To be more specific, on the representative cooling date in the DNN-based learning model, the misclassification may be caused when the operation state of the cooling and heating changes, cooling is performed, and the power is turned off.

Misclassification is caused by a steady decline in prediction probability for about 10 to 30 minutes after a change in heating and cooling operation state, which is due to the time lag between the power change and the change in temperature and humidity in the air.

During the cooling operation, the prediction probability decreases, increases, and then decreases again, which is caused by alternative blowing and cooling when the right temperature is reached during cooling.

Misclassification at power off remains low in predictive probability but occurs at 19:00 and 21:00-23:00. At this time, the air conditioner is not in use, but temperature and humidity changes due to activities such as cooking by the occupants are the cause of the misclassification.

It mainly occurs when the operation state of the EHP changes for a representative heating date in the DNN-based learning model, and when power heating is turned on from power-off state, it is recognized after about 5 to 10 minutes so that the prediction probability decreases sharply.

If a power off occurs from the power-on state, it will be recognized after about 30 to 70 minutes and the prediction probability will gradually decrease.

That is, the air conditioner is switched from off to on, the heating is quickly affected by the temperature and the humidity as compared with the cooling and when the running stops, the indoor temperature gradually decreases so that the prediction probability also gradually decreases.

As described above, when the operation state determining device according to the exemplary embodiment of the present invention is used, the operation state of the air conditioning device may be determined based on the indoor/outdoor environment data so that there are advantages in that the building energy may be efficiently and effectively managed and the indoor air quality may be efficiently improved.

Figure 9:
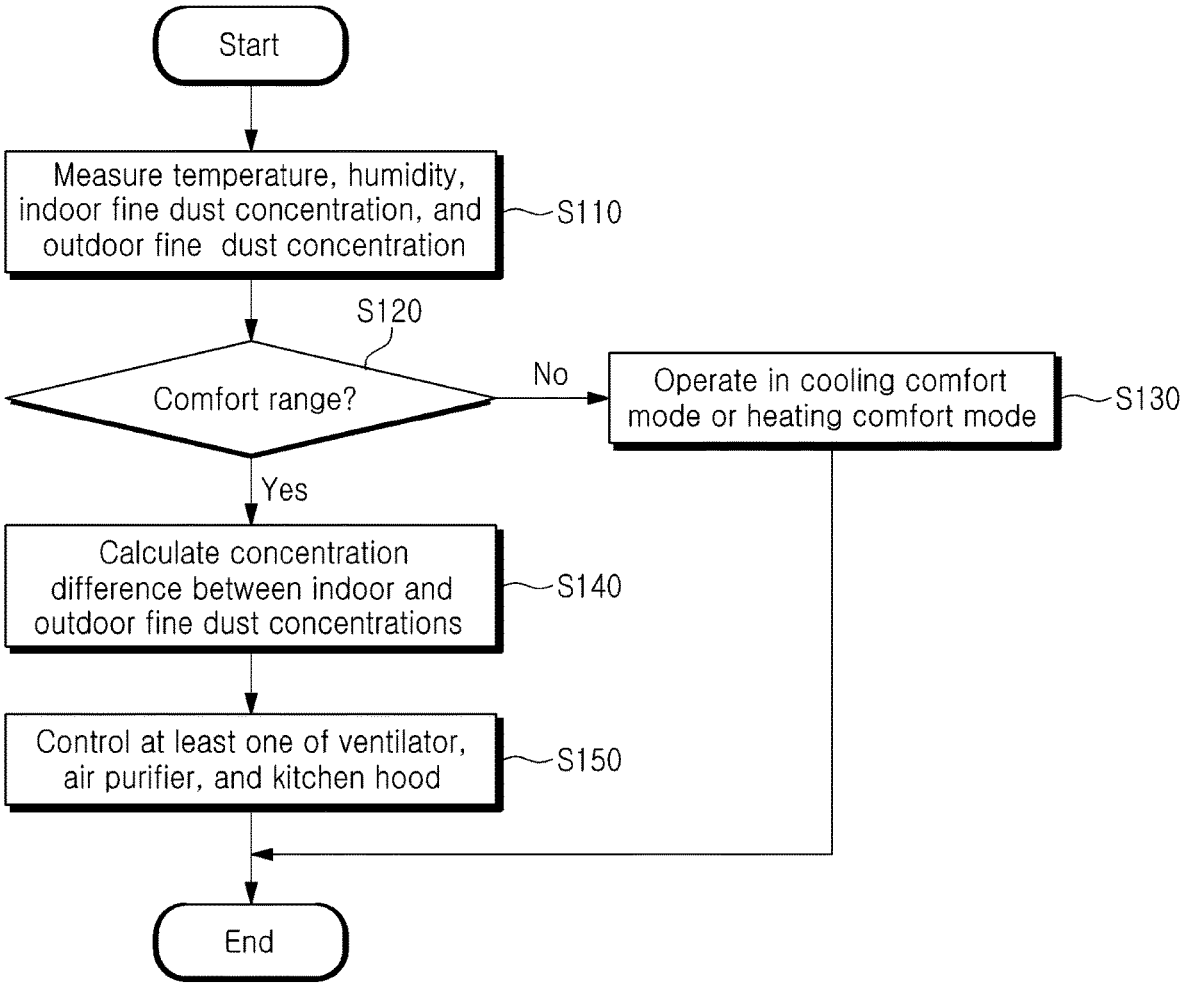
FIGS. 9 and 10 are flowcharts illustrating an operating method of an indoor environment control system according to the present invention.
Figure 10:
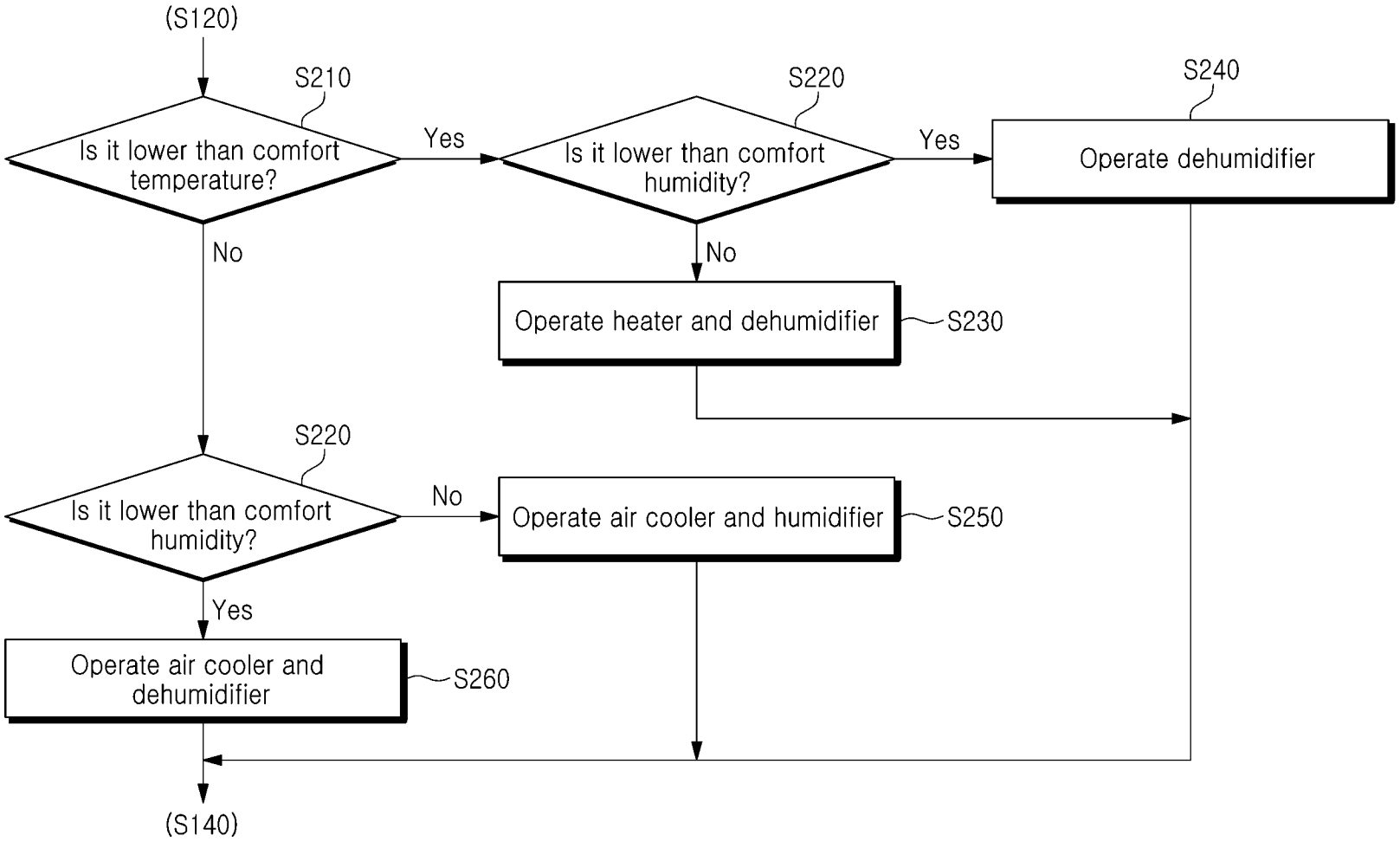

FIGS. 9 and 10 are flowcharts illustrating an operating method of an indoor environment control system according to the present invention.

Referring to FIG. 9, the control device 180 of the indoor environment control system 100 may measure indoor temperature, humidity, an indoor fine dust concentration, and an outdoor fine dust concentration (S110).

That is, the sensor module 210 included in the control device 180 may measure the indoor temperature and humidity, the indoor fine dust concentration, and the outdoor fine dust concentration.

The control device 180 determines whether the temperature and the humidity are within a preset comfort range (S120) and when the temperature and the humidity are not within the comfort range, it may operate in a cooling comfort mode or a heating comfort mode (S130).

The cooling comfort mode and the heating comfort mode will be described with reference to FIG. 10.

In step S120, when the temperature and the humidity are within the comfort range, the control device 180 compares the indoor fine dust concentration and the outdoor fine dust concentration to calculate a concentration difference (S140) and control an operation of at least one of a ventilator 110, an air purifier 120, and a kitchen hood 130 based on the concentration difference (S150).

That is, the control module 220 included in the control device 180 may calculate a concentration difference by comparing the indoor fine dust concentration and the outdoor fine dust concentration.

Here, the concentration difference is a value obtained by subtracting the outdoor fine dust concentration from the indoor fine dust concentration. For example, when the concentration difference has a negative (−) value, it means that the outdoor fine dust concentration is higher than the indoor fine dust concentration. Further, when the concentration difference has a positive (+) value, it means that the indoor fine dust concentration is higher than the outdoor fine dust concentration.

The control module 220 may determine whether the concentration difference is within any one of the first to third reference concentration difference ranges.

First, the first reference concentration difference range is a range in which the indoor fine dust concentration is higher than the outdoor fine dust concentration and the second reference concentration difference range is a range in which the indoor fine dust concentration is higher than the outdoor fine dust concentration and is larger than the range of the first reference concentration difference.

The third reference concentration difference range may indicate a range in which the indoor fine dust concentration is lower than the outdoor fine dust concentration.

When the concentration difference is within the range of the first reference concentration difference, the control module 220 may operate the ventilator 110 and the kitchen hood 130 to be turned on depending on the first reference concentration difference.

That is, the indoor fine dust concentration is higher than the outdoor fine dust concentration so that the control module 220 may operate the ventilator 110 and the kitchen hood 130 to be turned on to exhaust the indoor air to the outside.

At this time, when the ventilator 110 and the kitchen hood 130 include fans, the control module 220 may adjust the speed of the fans.

When the concentration difference is within the range of the second reference concentration difference, the operation module 240 may operate the ventilator 110, the air purifier 120, and the kitchen hood 130 to be turned on depending on the second reference concentration difference.

That is, the indoor fine dust concentration is higher than the outdoor fine dust concentration so that the control module 220 may operate the ventilator 110, the air purifier 120, and the kitchen hood 130 to be turned on to exhaust the indoor air to the outside and purify the indoor air.

When the concentration difference is within the range of the third reference concentration difference, the control module 220 may operate the air purifier 120 to be turned on depending on the third reference concentration difference.

That is, the outdoor fine dust concentration is higher than the indoor fine dust concentration so that the control module 220 may operate the air purifier 120 to be turned on to prevent the outdoor air from entering the room and maintain the current state of the indoor air.

In the exemplary embodiment, it has been described that the control module 220 controls operations of the ventilator 110, the air purifier 120, and the kitchen hood 130 based on the indoor, outdoor fine dust concentrations, the indoor temperature and humidity. However, the indoor carbon dioxide concentration and VOC concentration may be added to control the operations, but it is not limited thereto.

FIG. 10 illustrates a step S130 of FIG. 9 in detail.

When the temperature is not within the comfort range, the control device 180 may determine whether the temperature is lower than a comfort temperature included in the comfort range (S210) and determine whether the humidity is lower than a comfort humidity included in the comfort range (S220).

As the comfort range, for example, the comfort temperature may be 24.4° ° C. to 26.5° C. and the comfort humidity may be 40% to 55%. The comfort range may be changed by the user.

As a result of steps S210 and S220, when the temperature is lower than the comfort temperature and the humidity is higher than the comfort humidity, the control device 180 may operate in a heating comfort mode to operate at least one of the heater 140 and the dehumidifier 170 (S230).

As a result of steps S210 and S220, when the temperature is lower than the comfort temperature and the humidity is lower than the comfort humidity, the control device 180 may operate in a heating comfort mode to operate the heater 140 (S240).

As a result of steps S210 and S220, when the temperature is higher than the comfort temperature and the humidity is within the comfort humidity, the control device 180 may operate in a cooling comfort mode to operate the heater 140 (S250).

As a result of steps S210 and S220, when the temperature is higher than the comfort temperature and the humidity is lower than the comfort humidity, the control device 180 may operate in a cooling comfort mode to operate at least one of the air cooler 150 and the humidifier 160 (S260).

Figure 11:
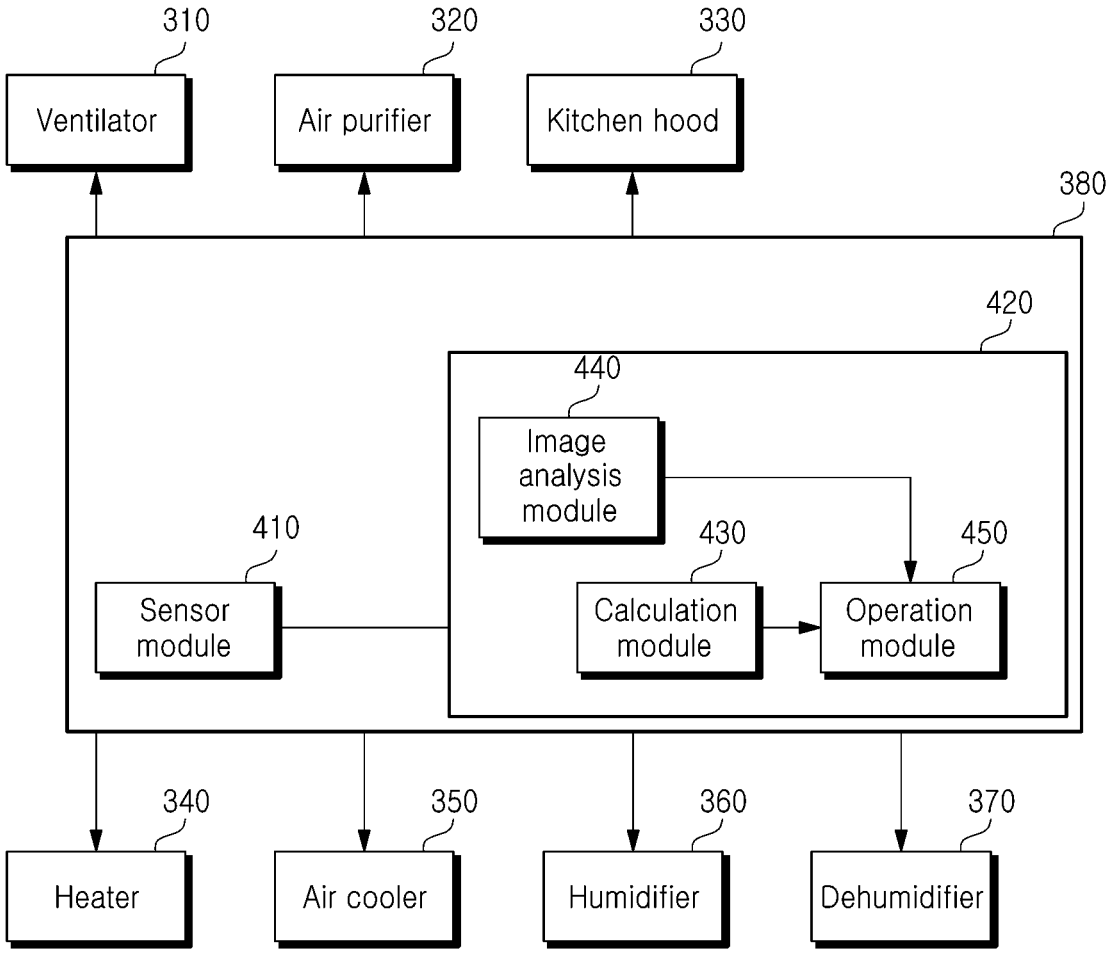
FIG. 11 is a control block diagram illustrating a configuration of an indoor environment control system according to a second exemplary embodiment of the present invention.

FIG. 11 is a control block diagram illustrating a configuration of an indoor environment control system according to a second exemplary embodiment of the present invention.

Referring to FIG. 11, the indoor environment control system 300 may include a ventilator 310, an air purifier 320, a kitchen hood 330, a heater 340, an air cooler 350, a humidifier 360, a dehumidifier 370, and a control device 380.

In an exemplary embodiment, the indoor environment device (not illustrated) may include a ventilator 310, an air purifier 320, and a kitchen hood 330 and these devices may be devices for improving the indoor air quality but are not limited thereto.

The thermal comfort device (not illustrated) may include a heater 340, an air cooler 350, a humidifier 360, and a dehumidifier 370 and these may be devices which improve the thermal comfort by adjusting the indoor temperature and humidity but are not limited thereto.

The ventilator 310 is a forced air ventilation device using the energy and may perform a function of improving the indoor air quality although it has slightly less control over temperature and humidity.

The air purifier 320 may perform a function of improving an indoor air quality by removing foreign materials included in the indoor air.

The kitchen hood 330 may exhaust carbon dioxide and odors generated during cooling to the outside and additionally perform a function of improving the indoor air quality.

The heater 340 may perform the heating function by increasing the indoor temperature and the air cooler 350 may perform a cooling function of lowering the indoor temperature, unlike the heater 340.

The humidifier 360 and the dehumidifier 370 may perform a function of adjusting the indoor humidity.

The control device 380 may include a sensor module 410 and a control module 420.

The sensor module 410 may include a plurality of sensors which is capable of measuring an indoor temperature, an indoor humidity, an indoor fine dust concentration, and an outdoor fine dust concentration, but is not limited thereto.

For example, the plurality of sensors may include a temperature sensor, a humidity sensor, an odor sensor, a dust sensor, and the like, but is not limited thereto.

Further, the sensor module 420 may include an image sensor which captures indoor images.

The control module 420 may include a calculation module 430, an image analysis module 440, and an operation module 450.

The calculation module 430 may calculate a concentration difference by comparing the indoor fine dust concentration and the outdoor fine dust concentration.

Here, the concentration difference is a value obtained by subtracting the outdoor fine dust concentration from the indoor fine dust concentration. For example, when the concentration difference has a negative (−) value, it means that the outdoor fine dust concentration is higher than the indoor fine dust concentration. Further, when the concentration difference has a positive (+) value, it means that the indoor fine dust concentration is higher than the outdoor fine dust concentration.

First, when the indoor temperature and humidity are input, the operation module 450 may determine whether the temperature and the humidity are within the set comfort range.

The image analysis module 440 may analyze the behavior of the occupant based on the indoor image captured by the image sensor included in the sensor module 420.

That is, the image analysis module 440 may infer generated fine dust concentrations that may be generated based on occupant behavior, for example, cleaning, exercising, cooking, or the like.

Here, the generated fine dust concentration may be a predictive value of the fine dust concentration generated after the present time according to the behavior of the occupant.

That is, the operation module 450 determines whether the temperature and the humidity are within the comfort range before improving the indoor air quality to increase the thermal comfort.

As the comfort range, for example, the comfort temperature may be 24.4° C. to 26.5° C. and the comfort humidity may be 40% to 55%. The comfort range may be changed by the user.

When the temperature is lower than the comfort temperature and the humidity is higher than the comfort humidity, the operation module 450 may operate in a heating comfort mode to operate at least one of the heater 340 and the dehumidifier 370.

Further, when the temperature is lower than the comfort temperature and the humidity is within the comfort humidity, the operation module 450 may operate in a heating comfort mode to operate the heater 340.

When the temperature is higher than the comfort temperature and the humidity is lower than the comfort humidity, the operation module 450 may operate in a cooling comfort mode to operate at least one of the air cooler 350 and the humidifier 360.

When the temperature is higher than the comfort temperature and the humidity is higher than the comfort humidity, the operation module 450 may operate in a cooling comfort mode to operate at least one of the air cooler 350 and the dehumidifier 370.

The operation module 450 may control an operation of at least one of the ventilator 310, the air purifier 320, and the kitchen hood 330 based on the concentration difference from the calculation module 430 and the generated fine dust concentration input by the image analysis module 440.

Here, the operation module 450 may control an operation time of at least one of the ventilator 310, the air purifier 320, and the kitchen hood 330 based on the generated fine dust concentration.

For example, when the generated fine dust concentration is higher than a preset reference generated concentration, the operation module 450 may increase an operation time of at least one of the ventilator 310, the air purifier 320, and the kitchen hood 330.

Thereafter, when it operates in a heating or cooling comfort mode, the control module 450 may determine whether the concentration difference is within any one of the first to third reference concentration difference ranges.

First, the first reference concentration difference range may be a range in which the indoor fine dust concentration is higher than the outdoor fine dust concentration and the second reference concentration difference range may be a range in which the indoor fine dust concentration is higher than the outdoor fine dust concentration and is larger than the range of the first reference concentration difference.

The third reference concentration difference range may indicate a range in which the indoor fine dust concentration is lower than the outdoor fine dust concentration.

When the concentration difference is within the range of the first reference concentration difference, the operation module 450 may operate the ventilator 310 and the kitchen hood 330 to be turned on depending on the first reference concentration difference.

That is, the indoor fine dust concentration is higher than the outdoor fine dust concentration so that the operation module 450 may operate the ventilator 310 and the kitchen hood 330 to be turned on to exhaust the indoor air to the outside.

At this time, when the ventilator 310 and the kitchen hood 330 include fans, the operation module 450 may adjust the speed of the fans.

When the concentration difference is within the range of the second reference concentration difference, the operation module 450 may operate the ventilator 310, the air purifier 320, and the kitchen hood 330 to be turned on depending on the second reference concentration difference.

That is, the indoor fine dust concentration is higher than the outdoor fine dust concentration so that the operation module 450 may operate the ventilator 310, the air purifier 320, and the kitchen hood 330 to be turned on to exhaust the indoor air to the outside and purify the indoor air.

When the concentration difference is within the range of the third reference concentration difference, the operation module 450 may operate the air purifier 320 to be turned on depending on the third reference concentration difference.

That is, the outdoor fine dust concentration is higher than the indoor fine dust concentration so that the operation module 450 may operate the air purifier 320 to be turned on to prevent the outdoor air from entering the room and maintain the current state of the indoor air.

The indoor environment control system 300 according to the present invention has advantages of increasing the thermal comfort in consideration of the indoor temperature and humidity and improving the indoor air quality in consideration of the indoor fine dust concentration in the room, the outdoor fine dust concentration, and the occupant's behavior.

The features, structures, effects and the like described in the foregoing exemplary embodiments are included in at least one embodiment of the present disclosure and are not necessarily limited to one embodiment. Moreover, the features, structures, effects and the like illustrated in each exemplary embodiment may be combined or modified by those skilled in the art for the other exemplary embodiments to be carried out. Therefore, the combination and the modification of the present disclosure are interpreted to be included within the scope of the present disclosure.

In the above description, the present disclosure has been described based on the exemplary embodiments, but the exemplary embodiments are for illustrative, and do not limit the present disclosure, and those skilled in the art will appreciate that various modifications and applications, which are not exemplified in the above description, may be made without departing from the scope of the essential characteristic of the present exemplary embodiments. For example, each constituent element specifically present in the exemplary embodiment may be modified and carried out. Further, the differences related to the modification and the application should be construed as being included in the scope of the present disclosure defined in the accompanying claims.

The invention claimed is:

1. An indoor environment control system, the system comprising:

an indoor environment device including a ventilator, an air purifier, and a kitchen hood;

a thermal comfort device including a heater, an air cooler, a humidifier, and a controller; and a control device including a sensor module and configured to control an operation of at least one of the indoor environment device and the thermal comfort device based on an indoor fine dust concentration and an outdoor fine dust concentration, when indoor temperature and humidity are within a preset comfort range, wherein the control device is further configured to:

measure, by the sensor module, the indoor temperature, the humidity, the indoor fine dust concentration, and the outdoor fine dust concentration;

compare the indoor fine dust concentration and the outdoor fine dust concentration to control an operation of at least one of the ventilator, the air purifier, and the kitchen hood, when the indoor temperature and the humidity are within the preset comfort range;

calculate a concentration difference by comparing the indoor fine dust concentration and the outdoor fine dust concentration; and control the operation of at least one of the ventilator, the air purifier, and the kitchen hood according to the concentration difference, and wherein when the concentration difference is within a third reference concentration difference range and the indoor fine dust concentration is lower than the outdoor fine dust concentration, the control device operates the air purifier according to the third reference concentration difference range to be turned on.

2. The system of claim 1, wherein when the concentration difference is within a first reference concentration difference range and the indoor fine dust concentration is higher than the outdoor fine dust concentration, the control device operates the ventilator and the kitchen hood according to the first reference concentration difference range to be turned on.

3. The system of claim 1, wherein when the concentration difference is within a second reference concentration difference range and the indoor fine dust concentration is higher than the outdoor fine dust concentration, the control device operates the ventilator, the kitchen hood, and the air purifier according to the second reference concentration difference range to be turned on.

4. The system of claim 1, further comprising a sensor configured to measure arbitrary indoor and outdoor environment data, wherein the system is configured to determine an operation state of at least one of the heater and the air cooler, collect operation state data of an air conditioning device which cools and heats indoor, and train a machine learning model based on the arbitrary indoor and outdoor environment data and the operation state data to generate a learning model to predict the operation state of the air conditioning device for the arbitrary indoor and outdoor environment data.

5. The system of claim 1, wherein the control device:

is configured to measure a power consumption value consumed by every electronic device, and extract behavior information of an occupant located in a room by applying an indoor environment value and the power consumption value to a preset occupant behavior classification model and control the indoor environment device to maintain the indoor environment value as a reference indoor environment value corresponding to the behavior information.

6. An operation method of an indoor environment control system, comprising:

measuring indoor temperature and humidity, an indoor fine dust concentration, and an outdoor fine dust concentration;

determining whether the indoor temperature and the humidity are within a preset comfort range;

calculating a concentration difference by comparing the indoor fine dust concentration and the outdoor fine dust concentration when the indoor temperature and the humidity are within the preset comfort range; and controlling an operation of at least one of a ventilator, an air purifier, and a kitchen hood included in an indoor environment device based on the concentration difference, wherein, in the controlling the operation, when the concentration difference is within a third reference concentration difference range and the indoor fine dust concentration is lower than the outdoor fine dust concentration, the air purifier operates to be turned on according to the third reference concentration difference range.

7. The operation method of the indoor environment control system of claim 6, further comprising:

operating at least one of a heater, an air cooler, a humidifier, and a dehumidifier so that the indoor temperature and the humidity fall into the preset comfort range when the indoor temperature and the humidity are not within the preset comfort range.

8. The operation method of the indoor environment control system of claim 6, wherein in the controlling the operation, when the concentration difference is within a first reference concentration difference range and the indoor fine dust concentration is higher than the outdoor fine dust concentration, the ventilator and the kitchen hood operate to be turned on according to the first reference concentration difference range.

9. The operation method of the indoor environment control system of claim 6, wherein in the controlling the operation, when the concentration difference is within a second reference concentration difference range and the indoor fine dust concentration is higher than the outdoor fine dust concentration, the ventilator, the kitchen hood, and the air purifier operate to be turned on according to the second reference concentration difference range.

10. An indoor environment control system, the system comprising:

an indoor environment device including a ventilator, an air purifier, and a kitchen hood;

a thermal comfort device including a heater, an air cooler, a humidifier, and a controller; and a control device including a sensor module and configured to control an operation of at least one of the indoor environment device and the thermal comfort device based on an indoor fine dust concentration and an outdoor fine dust concentration, when indoor temperature and humidity are within a preset comfort range, wherein the control device is further configured to:

measure, by the sensor module, the indoor temperature, the humidity, the indoor fine dust concentration, and the outdoor fine dust concentration;

compare the indoor fine dust concentration and the outdoor fine dust concentration to control an operation of at least one of the ventilator, the air purifier, and the kitchen hood, when the indoor temperature and the humidity are within the preset comfort range;

measure a power consumption value consumed by every electronic device;

extract behavior information of an occupant located in a room by applying an indoor environment value measured by the sensor module and the power consumption value to a preset occupant behavior classification model; and control the indoor environment device to maintain the indoor environment value as a reference indoor environment value corresponding to the behavior information.

* * * * *